United States Patent [19]

Rule et al.

[11] 4,173,539

[45] Nov. 6, 1979

[54] CATIONIC SURFACTANT COMPOSITIONS

[75] Inventors: Robert B. Rule, Liverpool; Martin A. Wells, Wirral; John D. Dance, High Wycombe, all of England

[73] Assignee: Lever Brothers Company, New York, N.Y.

[21] Appl. No.: 956,234

[22] Filed: Oct. 31, 1978

[30] Foreign Application Priority Data

Oct. 31, 1977 [GB] United Kingdom ..... 45254/77

[51] Int. Cl.[2] ..... D06M 13/34

[52] U.S. Cl. ..... 252/8.8; 8/115.6; 252/8.75; 252/8.9

[58] Field of Search ..... 252/8.8, 8.75, 8.9; 8/115.6

[56] References Cited

U.S. PATENT DOCUMENTS

| | | | |
|---|---|---|---|
| 3,920,563 | 11/1975 | Wixon | 252/8.8 |
| 3,920,565 | 11/1975 | Morton | 252/8.75 |
| 3,997,453 | 12/1976 | Wixon | 252/8.75 |
| 4,000,077 | 12/1976 | Wixon | 252/8.75 |

*Primary Examiner*—William E. Schulz
*Attorney, Agent, or Firm*—Melvin H. Kurtz

[57] ABSTRACT

A pourable, stable, liquid fabric-softening composition comprises an aqueous dispersion of particulate softening agent which comprises an quaternary ammonium salt having one straight-chain aliphatic hydrocarbon radical, complexed with an anion of an anionic surfactant in a normality ratio of 1.1:1 to 5:1.

12 Claims, No Drawings

CATIONIC SURFACTANT COMPOSITIONS

This invention relates to cationic surfactant compositions and to processes for preparing them.

Certain quaternary ammonium salts containing at least one long-chain aliphatic hydrocarbon group in the molecule are cationic surfactants which can be used as fabric softeners in the rinse following a washing process. The only ones of commercial importance as fabric softeners up to the present have two long-chain aliphatic hydrocarbon groups, for example di (hardened tallow) dimethylammonium chloride and 2-heptadecyl-1-methyl-stearoylamidoethyl imidazoline methosulphate. Cationic surfactants containing only one long-chain aliphatic hydrocarbon group are also fabric softeners, but problems arise in formulating them into stable liquid dispersions.

Cationic surfactants with valuable fabric-softening properties that contain only one long-chain aliphatic hydrocarbon group in the molecule are more water-soluble than those of corresponding structure with two such groups, and this gives rise to problems in formulating them as aqueous concentrates. Aqueous concentrates of such quaternary ammonium salts, containing for instance 6% by weight, are readily obtained by dispersing them in hot water and cooling. However, many such quaternary ammonium salts, for instance 3-acyloxy-2-hydroxy-propyl trimethylammonium chlorides, thus provide concentrates that initially have a sufficiently low viscosity for easy pouring, but tend to form gels on storage at ambient temperatures and often become difficult, if not impossible, to pour. Others, for instance cetylpyridinium bromide, provide concentrates that tend to separate into two layers as the salt begins to crystallise out, so that the concentrate becomes inhomogeneous on standing.

It has been found that the tendency to form gels or become inhomogeneous can be avoided by formulating the quaternary ammonium salt as a partial complex with an anionic surfactant, but that both the ratio of quaternary ammonium salt to the anionic surfactant and the method of forming the complex are critical for providing a stable concentrated liquid dispersion in which quaternary ammonium cationic is present in particles having a net positive charge so that these are substantive to fabric and confer softening properties.

Aqueous liquid compositions containing complexes derived from quaternary ammonium salt softeners and anionic surfactants have already been disclosed in the patent literature. Such literature disclosures are in principle concerned with the formulation of quaternary softeners with two long-chain aliphatic hydrocarbon groups and although mention is made of the more soluble compounds with only one such group, the special problems they present have never been recognised. Usually no specific directions are given for their formulation and they are treated as wholly analogous to the more insoluble softeners. Thus British Pat. No. 1,453,093 discloses fabric softening compositions containing a cationic softener and soap with a weight ratio of from 1:1 to 1:2 of cationic softener to soap and refers to homogeneous liquids containing them. Mention is made of a wide range of cationic softeners including quaternary ammonium salts with one or two long-chain aliphatic hydrocarbon groups. The only instructions given for formulation of liquid compositions are in connection with a softener with two long-chain aliphatic hydrocarbon groups and attempts to formulate corresponding compositions with softeners having only one such group have resulted in inhomogeneous compositions.

Where specific instructions are given in this literature for formulating liquid compositions with softeners having only one long-chain group reliance is placed on methods applied for compositions with softeners having two long-chain groups. Thus U.S. Pat. No. 3,920,565 concerns aqueous liquid compositions containing fabric softener and soap in properties corresponding to a range of from 0.5:1 to 30:1 by weight, and instructions are given for formulating softeners with single long-chain groups in manner analogous to that given for ditallow-dimethylammonium chloride. It has been found that when typical softeners with one long-chain group are used to prepare aqueous dispersions following this disclosure inhomogeneous products are obtained.

Other patents which disclose liquid compositions containing softener are, with the respective anionic surfactants concerned, British Pat. No. 1,434,831 (higher aliphatic or ethoxylated higher aliphatic alcohol sulphates), and British Pat. No. 1,408,525 and U.S. Pat. No. 3,997,453 (aromatic and other sulphonates). These likewise contain disclosures which do not recognise the special problems inherent in the formulation of single long-chain softeners.

It has now been discovered that stable liquid dispersions containing positively charged particles of quaternary ammonium salt softeners with single long-chain groups can be prepared if ratios of quaternary salt to anionic surfactant within critical ranges are employed and the quaternary salt and anionic surfactant are brought together in such a way that a homogeneous liquid phase is formed before the complex-containing softener particles are generated.

The critical range of ratios of single long-chain quaternary ammonium salt to anionic surfactant has been found to be within from 1.1:1 to 5:1, expressed as the ratio of normalities of these substances, where normality is the molar concentration divided by the number of effective cationic or anionic charges present in the quaternary ammonium salt and anionic surfactant respectively. Within these limits of normality ratios the operative limits have been found to be specific to the particular quaternary ammonium salts and anionic surfactants employed, and can be determined by a process of simple testing. The effective ratio ranges found for a series of quaternary ammonium salts and anionic surfactants is given in the following table. The prior art disclosures of relative proportions of quaternary ammonium salts and anionic surfactants are without relation to the capacity of a quaternary ammonium salt to form a complex with an anionic surfactant by the combination of one cation with one anion to form an insoluble salt that is reflected in the normality ratios referred to above, which do not take account of the molecular weights of the anions and cations, but the corresponding normality ratios can be calculated from the weight ratio ranges using the molecular weights of the compounds of lowest and highest molecular weight disclosed, the quaternary ammonium salts being those having one long-chain aliphatic hydrocarbon group, and these calculated normality ratio ranges are given in the table for comparison.

The ranges of figures in the table are the ranges of normality ratios expressed as quaternary ammonium salt to 1 of anionic surfactant.

| Quaternary ammonium salts | |
|---|---|
| Stearyltrimethylammonium chloride | A |
| Tallow fatty acid acylcholine chloride | B |
| 3-Behenoyloxy-2-hydroxypropyltrimethyl-ammonium chloride | C |

| Anionic surfactants | A | B | C |
|---|---|---|---|
| Sodium stearate | | | 1.2–3.0 |
| Sodium soap of tallow fatty acids | 1.1–1.6 | 1.8–2.6 | |
| Sodium random secondary $C_{13}$–$C_{17}$ alkane sulphonate | 1.3–2.0 | 1.5–3.5 | |
| Sodium $C_{15}$–$C_{18}$ olefin sulphonate | 1.4–1.8 | | |
| Sodium linear $C_{10}$–$C_{15}$ alkylbenzene sulphonate | 1.5–3.0 | 2.0–3.5 | |

| | Minimum ratios | Maximum ratios |
|---|---|---|
| Fatty acid soaps | | |
| British Patent 1,453,093 | 0.13–0.66 | 0.25–1.33 |
| U.S. Pat. No. 3,920,565 | 0.28–0.68 | 16.7–41.1 |
| Alcohol sulphates | | |
| British Patent 1,434,831 | 0.98–2.91 | 4.9–14.6 |
| Sulphonates | | |
| British Patent 1,408,525 | 0.66–1.20 | 33–60 |
| U.S. Pat. No. 3,997,453 | 2.0–3.6 | 53–96 |

There is no specific disclosure of the preparation of aqueous liquid concentrates in these prior publications of stable dispersions containing positively charged particles of quaternary ammonium softeners with single long-chain groups, and to prepare these it is necessary both to select a normality ratio within the operative range for the particular quaternary ammonium salt and anionic surfactant concerned and to employ a method of formulation which gives a homogeneous liquid phase before generating the complex-containing softener particles. It has been found that compositions of the invention cannot be obtained using the methods of formulation disclosed in British Pat. Nos. 1,434,831 and 1,453,093 and U.S. Pat. No. 3,920,565 even using normality ratios within the range 1.1:1 to 5:1: the selection of normality ratio within this range is essential using the anionic surfactants of British Pat. No. 1,408,525 and U.S. Pat. No. 3,997,453, whereas all the normality ratios of specific compositions they describe lie between 10:1 and 20:1: the employment of such high ratios results in solubilisation by the excess quaternary ammonium salt so that the compositions do not have a clear point above 95° C. and a stable dispersion of positively charged particles of softening agent is not obtained.

The present invention provides a pourable liquid fabric softening composition of uniform turbidity comprising a dispersion in an isotropic aqueous medium of positively charged particles of softening agent with a melting point of below 95° C., which particles comprise a quaternary ammonium salt fabric softener having one straight-chain aliphatic hydrocarbon radical with from 12 to 24 carbon atoms, the chloride salt of whose cation A has a Krafft point in water of less than 95° C., complexed with the anion B of an anionic surfactant salt having one straight-chain aliphatic hydrocarbon group with from 12 to 24 carbon atoms, the normality ratio of A to B being in the range from 1.1:1 to 5:1, the total weight of A and B present being from 2 to 15% by weight of the composition, and the composition having a clear point of above 95° C.

A composition of uniform turbidity can be recognised simply by visual observation of a sample which has been placed in a test tube and allowed to stand for 24 hours at ambient temperature. The isotropy of the aqueous medium can be recognised by placing a sample of the composition on a slide, covering the slide with a glass slip and observing the sample under a microscope between crossed polarisers using bright field illumination at magnification ×100: a uniformly dark appearance of the continuous phase indicates that the liquid medium of the sample is isotropic. The presence of positively charged particles of softening agent in the composition can be recognised by dispersing it in demineralised water to give a 0.01% concentration based on the total weight of quaternary ammonium salt and anionic surfactant present, subjecting a sample of the diluted composition to a potential difference and observing under a microscope the direction of motion of the softener particles present: movement towards the negative pole indicates that the particles are positively charged. The melting point of particles of softening agent can be determined by placing in a hot stage microscope a sample of composition on a glass slide covered by a glass cover slip and observing the temperature at which melting of the particle occurs as a change in shape of the particles indicating deformation of liquid droplets when the cover slip is moved over the slide. The Krafft point (Kp) of the quaternary ammonium chloride can be determined by heating an aqueous dispersion containing 2% by weight of it to a temperature at which a transparent solution is obtained, cooling it, and observing the temperature at which it becomes cloudy. The clear point of the composition can be determined by heating a sample to 95° C.: lack of optical clarity at this temperature is taken as showing that the clear point is above 95° C.

Quaternary ammonium salt fabric softeners, the chloride salt of whose cation A has a Krafft point in water of less than 95° C., that are suitable for use in the compositions of the invention are to be found within the class of compounds having the structure $R'—AR_3N^+X^-$, where R' is a straight-chain aliphatic hydrocarbon radical having from 12 to 24 carbon atoms, A represents a single bond or a group —COOR″—, —OOCR″—, —CONHR″—, —NHCOR″—, $—SO_2NMR''—$, or $—Y_m(OCH_2CH_2)_n—$ where R″ is an alkylene or hydroxyalkylene group having from 1 to 3 carbon atoms, and Y is a phenylene group, m is 0 or 1 and n is 1 to 3, and (a) each group R is an alkyl or hydroxyalkyl group having from 1 to 6 carbon atoms or a benzyl group, or (b) 2 or 3 of the groups R taken together with the nitrogen atom represent a heterocyclic radical and any remaining group R is an alkyl or hydroxyalkyl group having from 1 to 6 carbon atoms or a benzyl group, and $X^-$ is an anion. Preferably the quaternary ammonium salt has one of the structures $R^1R_3N^+X^-$, $R^1OOCCH_2R_3N^+X^-$, $R^1COOCH_2CH_2R_3N^+X^-$, $R^1CONHCH_2CH_2R_3X^+X^-$ and $R^1COOCH_2CHOHCH_2R_3X^+X^-$, where $R^1$ is a straight-chain aliphatic hydrocarbon group having from 12 to 24 carbon atoms, and either (a) each group R is an alkyl or hydroxyalkyl group having from 1 to 6 carbon atoms or a benzyl group, or (b) 2 or 3 of the groups R taken together with the nitrogen atom represent a heterocylic radical, and any remaining group R is an alkyl or hydroxyalkyl group having from 1 to 6 carbon atoms or a benzyl group, and $X^-$ is an anion. The aliphatic hydrocarbon groups R and $R^1$ can be alkyl or alkenyl groups.

Thus is such compounds where appropriate R' and $R^1$ can be a cetyl, n-heptadecyl, stearyl, oleyl, n-eicosyl or n-tetracosyl group; R can be a methyl, ethyl, propyl, hydroxyethyl, hydroxypropyl or benzyl groups, 2 groups R taken together with the nitrogen atom can represent a morpholinium, piperidinium or pyrollidinium group, and 3 groups R taken together with the nitrogen atom can represent a pyridinium group; and $R^1CO$ can be a palmitoyl, stearoyl, arachidoyl, erucoyl, behenoyl or lignoceroyl group. The anion $X^-$ is preferably the anion of a strong acid, and can for example be a halide or methosulphate. An anion can carry a double charge, as with sulphate, and in such an instance $X^-$ represents half a unit group. Particularly valuable are compositions in which the quaternary ammonium salt is a $C_{14}$ to $C_{20}$ alkyl trialkylammonium salt, especially where the latter alkyl groups are each methyl. Mixtures of quaternary ammonium salts can be used, for example a salt in which one or more of the radicals R' or $R^1$ is derived from an intermediate containing mixed radicals. Thus a group R', $R^1$ or $R^1CO$ can be a mixture of long-chain aliphatic hydrocarbon or acyl radicals corresponding to hydrogenated tallow fatty acid, or technical behenic acid containing minor proportions of acids other than behenic acid.

Specific examples of suitable quaternary ammonium salts are celtyltrimethylammonium bromide
stearyltrimethylammonium chloride (Kp 11° C.)
cetylbenzyldimethylammonium chloride (Kp 16° C.)
myristoyloxyethyl trimethylammonium iodide
stearoyloxyethyl trimethylammonium chloride
tallow fatty acylcholine chloride (Kp 40° C.)
eicosyloxycarbonylmethyl trimethylammonium chloride
stearoylaminoethyl triethylammonium chloride
behenoylaminopropyl trimethylammonium chloride (Kp 60° C.)
cetylsulphonylaminoethyl trimethylammonium methosulphate
stearyloxyethyleneoxyethyl tripropylammonium chloride
cetylpyridinium chloride (Kp 15°–17° C.)
3-cetyloxy-2-hydroxypropyl trimethylammonium chloride
3-behenoyloxy-2-hydroxypropyl trimethylammonium chloride (Kp 54° C.).

The preparation of such compounds is already described in the cationic surfactant literature, for instance that of acyloxyhydroxypropyl trialkylammonium salts is described in British Pat. No. 980,003.

The anion B of an anionic surfactant salt can be provided by a water-soluble or water-dispersible alkali metal salt of an organic acid having one straight-chain aliphatic hydrocarbon radical with from 12 to 24 carbon atoms, especially a sodium or potassium salt, or a corresponding ammonium or substituted ammonium salt. Alternatively the anion B can be provided by the corresponding free organic acid. The organic polar group of the salt or acid can be carboxylate, sulphate or sulphonate, and the anion-providing compound can have more than one such polar group. Examples of suitable organic acids providing the anion are natural and synthetic aliphatic carboxylic acids having from 12 to 24 carbon atoms, for instance myristic, palmitic, stearic, oleic and behenic acids, especially those of the soaps obtained by splitting triglyceride oils, for instance tallow fatty acid, which is a mixture of fatty acids consisting mainly of palmitic, stearic and oleic acids; alkylsulphuric acids having from 12 to 24 carbon atoms, for instance lauryl, cetyl, and palmityl hydrogen sulphates; alkane and olefin sulphonic acids having from 12 to 24 carbon atoms, for instance lauryl, myristyl, cetyl and stearyl sulphonic acids, and especially olefin sulphonates derived by reaction of sulphur trioxide with linear $\alpha$-olefins, or by reaction of alkanes with sulphur dioxide and chloride and subsequent hydrolysis, or by reaction of olefins with bisulphites; alkylether sulphuric acids obtained by reaction of molar quantities of alcohols having from 12 to 24 carbon atoms with 1 to 15 mols of ethylene oxide and subsequent reaction of the condensation products with sulphur trioxide; alkylbenzene sulphonic acids whose alkyl groups contain from 12 to 24 carbon atoms, for instance dodecylbenzene sulphonic acid; alkyl sulphosuccinates whose alkyl groups have from 12 to 24 carbon atoms, derived by reacting maleic acid esters with bisulphites; acyloxysulphonic acids, for instance acyloxyethyl and 3-acyloxy-2-hydroxypropyl sulphonic acids, whose acyl groups have from 13 to 25 carbon atoms, for example lauroyloxyethyl and stearoylhydroxypropyl sulphonic acids; and $\alpha$-carboxyalkyl sulphonic acids whose carboxyalkyl groups have from 13 to 25 carbon atoms, for instance sulphonated lauric and palmitic acids. Preferably the anion is one in which there is present an alkyl or alkenyl group having from 16 to 24 carbon atoms.

It has been found that when certain combinations of specific quaternary ammonium salts and alkyl sulphates are employed the complexes produced are highly crystalline, possibly because of lack of water in the complex, so that particles of them settle out rapidly from the dispersion obtained, which is not therefore of uniform turbidity. Such particles have a melting point above 95° C. and do not provide compositions of the invention. It is therefore necessary to choose the specific quaternary ammonium salt and alkyl sulphate combination so that this is avoided, as illustrated in Example 18 below.

The ratio of the normalities of the cation A and anion B in the compositions of the invention is from 1.1:1 to 5:1. Normality is the molar concentration divided by the number of effective cationic or anionic charges present in a molecule of quaternary ammonium salt or anion-providing compound respectively. The relative molar proportions are thus adjusted according to the numbers of cationic and anionic groups in those parts of the molecules providing ions carrying a large non-polar group. Hence one molar proportion of an anion-providing compound with one anionic group, for instance a fatty acid soap, is present with from 1.1 to 5 molar proportions of a quaternary ammonium salt having one cationic group, and one molar proportion of an anion-providing compound with two anionic groups, for instance a fatty acid sulphonate, is present with from 2.2 to 10 molar proprotions of a quaternary ammonium salt having one cationic group.

The concentration of the quaternary ammonium salt is preferably from 4 to 12% by weight of the composition. The compositions can contain minor amounts, for instance from 1 to 20%, of a hydrophilic organic solvent, for example isopropyl alcohol or hexylene glycol (2-methylpentane-2,4-diol). Nonionic surfactants, for instance condensates of linear and branched-chain aliphatic alcohols or carboxylic acids having from 8 to 22 carbon atoms with from 6 to 30 mols of ethylene oxide per mol of alcohol or acid, can be included in the compositions in minor amounts. The compositions can also contain perfume and colourants. The electrolyte content of the compositions should be low enough to avoid flocculation. The pH of the compositions will generally be between 2.5 and 9.

The concentration of water in a composition is from 98 to 85% by weight of the total of A,B and water present, and taking into account the presence of other minor ingredients is generally from 60 to 95% by weight of the total composition.

The viscosity of the composition depends on the size and numbers of the dispersed particles present, at least 75% of the particles generally being of diameter less than 10 microns. The viscosity can be chosen according to the prevailing user habit: for instance it can be within the ranges of from 15 to 80 cP or of from 100 to 150 cP.

A process for preparing a composition of the invention is one in which a homogeneous liquid mixture of the quaternary ammonium salt and anion-providing compound (prepared by heating to a suitable elevated temperature, in a solvent if desired) is mixed with water and subjected to shear at an elevated temperature until a dispersion is formed. In conducting the process the quaternary ammonium salt and anion-providing compound in the liquid phase can be mixed with water at a suitable elevated temperature, any colourant and ingredients other than perfume added, and the mixture subjected to shear to form an emulsion which is then cooled with stirring to form the aqueous dispersion, and any perfume required is then dispersed in the composition. Preferably the temperature at which the dispersion is formed is in the range of from 45° to 85° C.; the precise temperature is adjusted to the particular ingredients used by simple testing to give the viscosity desired. The quaternary ammonium salt as manufactured may be available as a paste in admixture with an organic solvent, for instance acyloxyhydroxypropyl trimethylammonium chlorides are generally available mixed with a minor amount of isopropyl alcohol or hexylene glycol containing some water.

The compositions of the invention are used as fabric softeners by addition to the rinse cycle in the normal way, and in amounts equivalent to those normally applicable to the quaternary ammonium salts. The invention includes a process for the softening of fabrics in which a composition of the invention is dispersed in water and fabric is contacted with the resulting dispersion, preferably containing from 0.002 to 0.035% of the quaternary ammonium salt.

The invention is illustrated by the following Examples in which amounts are by weight and temperatures are in °C., and the methods given above were used to determine the composition characteristics.

Preparation I of quaternary ammonium salt

Technical behenic acid (5.6 parts, containing 63.7% behenic acid, 0.9% palmitic acid, 22.3% stearic acid, 12.4% arachidic acid and 0.7% lignoceric acid) was mixed with isopropyl alcohol (4.2 parts) and the mixture heated until a clear solution was obtained: a solution of glycidyltrimethylammonium chloride (2.8 parts) in demineralised water (1.4 parts) was added and the charge heated with stirring under reflux for 2½ hours, giving 14 parts of a product containing 3-behenoyloxy-2-hydroxypropyl trimethylammonium chloride (59.6%, MW 475.7, Kp 58° ), isopropyl alcohol (29%) and water (9%), with by-products and unreacted starting material (2.4%).

Preparation II of quaternary ammonium salt

The product of Preparation I (1 part) was heated to a temperature at which it became clear, and mixed with diethyl ether (10 parts), which precipitated crystals of the quaternary salt. These crystals were removed by filtration, washed with acetone and dried under reduced pressure.

EXAMPLES 1 AND 2

A mixture of cetyltrimethylammonium bromide (9 parts MW 364), a commercial sodium linear $C_{10}$–$C_{15}$ alkyl benzene sulphonate (containing 91.8% of sulphonate, MW 358, 4.6% sodium sulphate, 0.4% sodium chloride and 1.9% water, 6.34 parts), isopropyl alcohol (8 parts) and water (4 parts) was heated to and maintained at 70° until it was wholly liquid. Sufficient demineralised water at 70° to bring the weight of the composition to 200 parts was added and the mixture stirred for 2 minutes and allowed to cool to ambient temperature.

A second composition was prepared in the same way, but with 4.75 parts of the anionic surfactant.

| Composition % | Example 1 | Example 2 |
|---|---|---|
| Quaternary ammonium salt | 4.5 | 4.5 |
| Anionic surfactant (active) | 2.91 | 2.18 |
| Cation | 3.51 | 3.51 |
| Anion | 2.72 | 2.04 |
| Total cation and anion | 6.23 | 5.55 |
| Normality ratio, cation/anion | 1.5 | 2.0 |
| Mp of softening agent particles | <30° | <30° |

EXAMPLES 3 TO 8

A mixture of stearyltrimethylammonium chloride (15.18 parts, containing 49% of the quaternary salt, Kp 11°, MW 345.8, dissolved in aqueous isopropyl alcohol), a commercial sodium soap of tallow fatty acid (4.61 parts, containing 99% of anionic surfactant, MW 299), isopropyl alcohol (5 parts) and water (5 parts) was heated to and maintained at 70° until it was wholly liquid. Sufficient demineralised water at 70° to bring the weight of the composition to 200 parts was added and the mixture stirred for 1 minute and allowed to cool to ambient temperature.

Further compositions were similarly prepared using the same quaternary ammonium salt in various proportions with the following anionic surfactants.

| Example | |
|---|---|
| 4 | A commercial random secondary $C_{13}$–$C_{17}$ alkane sulphonate detergent containing 73.3% of the active surfactant, MW 318, with 1,2% sodium sulphate and 24.7% water. |
| 5 | A commercial $C_{15}$–$C_{18}$ olefin sulphonate detergent containing 92.7% sodium olefin sulphonate (MW 329), 1.5% sodium sulphate, 1.8% sodium chloride and 2.6% water. |
| 6 | the alkyl benzene sulphonate detergent of Examples 1 and 2. |
| 7 | A mixture of a commercial sodium soap of coconut fatty acid containing 89.3% of the soap, MW 229, with the remainder salt and |

-continued

| Example | |
|---|---|
| | water, and the sodium soap of tallow fatty acid of Example 3, the two soaps being present in molecular equivalent amounts of anionic surfactant (average MW 264). |
| 8 | A mixture of the tallow soap of Example 3 and the random secondary alkane sulphonate of Example 4 in molecular equivalent amounts of anionic surfactant. |

The contents of the resulting compositions and their normality ratios and softening agent particle melting points were as follows:

| Composition % | Example No. 3 | 4 | 5 | 6 | 7 | 8 |
|---|---|---|---|---|---|---|
| Quaternary ammonium salt | 3.72 | 3.90 | 3.85 | 4.34 | 3.90 | 3.67 |
| Anionic surfactant (active) | 2.28 | 2.18 | 2.23 | 1.75 | 2.11 | 2.32 |
| Cation | 3.34 | 3.50 | 3.46 | 3.90 | 3.50 | 3.30 |
| Anion | 2.10 | 2.02 | 2.07 | 1.64 | 1.93 | 2.15 |
| Total cation and anion | 5.44 | 5.52 | 5.53 | 5.54 | 5.43 | 5.45 |
| Normality ratio, cation/anion | 1.4 | 1.65 | 1.65 | 2.55 | 1.4 | 1.4 |
| Mp of particles | 50° | <40° | 60° | 35-40° | <40° | 40° |

EXAMPLE 9

A mixture of stearyltrimethylammonium chloride (142.8 parts, containing 51% of the quaternary salt, Kp 11°, MW 345.8, dissolved in 75% aqueous isopropyl alcohol), a commercial sodium soap of tallow fatty acid (25.4 parts, containing 93% of anionic surfactant, MW 299 with the remainder salt and water), a commercial oleic acid (23.6 parts), and water (10 parts) was heated to and maintained at 70° until it was wholly liquid. This mixture was added during 1 minute to demineralised water (1792 parts) at 70° with stirring, the dispersion cooled to 40° and perfume (6 parts) added; after further stirring the composition was cooled to ambient temperature for storage. The composition had the following content and normality ratio, with softening agent particles melting at below 95°.

| Composition % | |
|---|---|
| Quaternary ammonium salt | 3.64 |
| Anionic surfactant and oleic acid | 2.36 |
| Cation | 3.27 |
| Anion | 2.28 |
| Total cation and anion | 5.55 |
| Normality ratio, cation/anion | 1.3 |

The viscosity of the composition measured with a Haake Rotovisko Concentric Cylinder viscometer at a shear rate of 110 $sec^{-1}$ was 20 cP.

EXAMPLES 10 TO 13

Compositions were prepared employing as quaternary ammonium salt tallow fatty acyl choline chloride, that is, the ester derived from choline and tallow fatty acid, containing 95.7% of active cationic surfactant and having MW 398.5 and Kp 40°.

A mixture of this tallow acyl choline ester (9.23 parts) and the tallow soap of Example 3 (2.77 parts), isopropyl alcohol (8 parts) and water (4 parts) was heated to and maintained at 70° until it was wholly liquid; demineralised water was added to bring the composition to 200 parts and the mixture was stirred for 1 minute and allowed to cool to ambient temperature.

Further compositions were similarly prepared using as anionic surfactant various proportions of the alkane sulphonate of Example 4, the olefin sulphonate of Example 5 and the alkyl benzene sulphonate of Example 6, giving compositions respectively of Examples 11, 12 and 13.

The contents of the composition and their normality ratios and softening agent particle melting points were as follows.

| Composition % | Example No. 10 | 11 | 12 | 13 |
|---|---|---|---|---|
| Quaternary ammonium salt | 4.42 | 4.05 | 3.96 | 4.78 |
| Anionic surfactant (active) | 1.37 | 2.00 | 2.04 | 1.23 |
| Cation | 4.16 | 3.82 | 3.73 | 4.50 |
| Anion | 1.26 | 1.86 | 1.90 | 1.15 |
| Total cation and anion | 5.42 | 5.68 | 5.63 | 5.65 |
| Normality ratio, cation/anion | 2.4 | 1.6 | 1.6 | 3.5 |
| Mp of particles | 50° | <95° | <95° | 40° |

EXAMPLES 14 TO 16

Compositions were prepared using as quaternary ammonium salt the 3-behenoyloxy-2-hydroxypropyltrimethylammonium chloride containing 93.2% of active surfactant described above in Preparation II, and as anionic surfactant, sodium stearate, MW 306.

The quaternary ammonium salt (9.66 parts) and sodium stearate (4.63 parts), isopropyl alcohol (10 parts) and water (5 parts) were mixed and heated to and maintained at 80° until the mixture was wholly liquid. Sufficient demineralised water at 80° to bring the weight of the composition to 200 parts was added, the mixture stirred for 2 minutes and allowed to cool to ambient temperature. Further compositions were prepared using reduced amounts of the stearate.

The contents, normality ratios and softening agent particle melting points of the compositions were as follows.

| Composition % | Example No. 14 | 15 | 16 |
|---|---|---|---|
| Quaternary ammonium salt | 4.5 | 4.5 | 4.5 |
| Anionic surfactant (active) | 2.32 | 1.93 | 1.45 |
| Cation | 4.28 | 4.28 | 4.28 |
| Anion | 2.16 | 1.78 | 1.34 |
| Total cation and anion | 6.44 | 6.06 | 6.62 |
| Normality ratio, cation/anion | 1.25 | 1.5 | 2.0 |
| Mp of particles | 60° | 60° | 60° |

EXAMPLE 17

A composition was prepared using as quaternary ammonium salt the behenoyl-hydroxypropyltrimethylammonium chloride of Preparation I above, containing 59.6% of active surfactant, 30% isopropyl alcohol and 10.4% water, and the quaternary salt having MW 475.7 and Kp 58°.

To this product (40 parts) was added tallow fatty acid (MW 277, 8 parts) and colourant (0.03 parts), and the mixture heated to 60° with stirring: demineralised water (352 parts) at 60° was added and the cloudy mixture stirred vigorously for 30 minutes at 60°, the resulting emulsion cooled to ambient temperature, and perfume (0.6 parts) finally incorporated with stirring.

The resulting composition contained 5.96% of quaternary ammonium salt, 2.0% of active anionic surfactant, 5.67% of the cation and 2.0% of the anion, the total of cation and anion being 7.67%, the normality ratio of cation to anion being 1.75:1, and the softening agent particle mp was 50°.

EXAMPLES 18 AND 19

To the quaternary ammonium salt preparation of Example 17 (14.69 parts) was added a commercial $C_{16}$–$C_{18}$ primary alkyl sulphate detergent (containing 95.6% of active anionic surfactant, MW 353, Kp 35°, 3.40 parts), isopropyl alcohol (5 parts) and water (4 parts) and the mixture heated to and maintained at 70° until completely clear: demineralised water (150 parts) at 70° was added with stirring for 1 minute, and the composition finally made up to 200 parts by addition of further water. A further composition was prepared in the same way from 16.1 parts of the quaternary ammonium salt, 2.57 parts of a commercial linear $C_{10}$–$C_{15}$ alkyl benzene sulphonate detergent containing 93.7% anionic surfactant (MW 358, Kp 6°) and 3.5% sodium sulphate, 3 parts of isopropyl alcohol and 4 parts of water.

The softening agent particle melting points of the compositions were below 95°. The contents of the resulting compositions and their normality ratios were as follows.

| Composition % | Example No. 18 | Example No. 19 |
|---|---|---|
| Quaternary ammonium salt | 4.38 | 4.80 |
| Anionic surfactant (active) | 1.63 | 1.21 |
| Cation | 4.17 | 4.57 |
| Anion | 1.48 | 1.13 |
| Total cation and anion | 5.65 | 6.70 |
| Normality ratio, cation/anion | 2.0 | 3.0 |

EXAMPLES 20 AND 21

To the quaternary ammonium salt of Example 17 (Preparation I, 40 parts) was added oleic acid (8 parts) and the mixture was heated to 80° with stirring: demineralised water (352 parts) at 80° was added and the mixture stirred for 30 minutes at this temperature and then cooled to ambient temperature. A similar composition was prepared with half the amount of oleic acid replaced by water.

The contents of the compositions and their normality ratios and softening agent particle melting points were as follows.

| Composition % | Example No. 20 | Example No. 21 |
|---|---|---|
| Quaternary ammonium salt | 5.96 | 5.96 |
| Anionic surfactant (active) | 2.00 | 1.00 |
| Cation | 5.67 | 5.67 |
| Anion | 2.00 | 1.00 |
| Total cation and anion | 7.67 | 6.67 |
| Normality ratio, cation/anion | 1.75 | 3.55 |
| Mp of particles | 30° | 30–40° |

EXAMPLE 22

A composition was prepared as in Example 21, but using the sodium tallow fatty acid soap of Example 3 (4 parts) instead of oleic acid, and with a mixing temperature of 70°; the composition contained 5.96% of quaternary ammonium salt, 1.0% of active anionic surfactant, 5.67% of the cation, 0.92% of the anion, the total of cation and anion being 6.59% and the normality ratio of cation to anion being 3.75:1. The softening agent particles had mp 60°.

EXAMPLES 23 TO 27

To the quaternary ammonium salt product of Preparation I above (40 parts) was added anionic surfactant (8 parts) and the mixture heated with stirring to 80°. Demineralised water (352 parts) at 80° was added and the cloudy mixture stirred at 600 rpm at 80° for 15 min., and cooled to ambient temperature. Compositions were prepared in this way using the following anionic surfactants.

| Example | |
|---|---|
| 23 | A commercial 3-acyloxy-2-hydroxypropyl sulphate detergent containing 82% sodium salt (MW 382), in which the acyl groups were derived from coconut oil fatty acid. |
| 24 | An alkane sulphonate detergent containing 80% sodium stearyl sulphonate (MW 356) and 16% sodium sulphate. |
| 25 | A commercial $C_{15}$–$C_{18}$ olefin sulphonate detergent containing 94% sodium olefin sulphonate (MW 329), and 2.3% sodium sulphate. |
| 26 | A commercial linear $C_{10}$–$C_{15}$ alkyl benzene sulphonate detergent containing 80% anionic surfactant (MW 356) and 16% sodium sulphate. |
| 27 | A sulphonated fatty acid sodium salt prepared from a mixture of 2% myristic, 49% palmitic, 46% stearic and 3% other saturated and unsaturated long-chain fatty acids, and containing 34% sodium fatty acid sulphonate (MW 400), 4.5% sodium soap (MW 298), 2% sodium sulphate and 57% water. |

The contents, normality ratios and softening agent particle mp of the compositions were as follows.

| Composition % | Example No. 23 | 24 | 25 | 26 | 27 |
|---|---|---|---|---|---|
| Quaternary ammonium salt | 5.96 | 5.96 | 5.96 | 5.69 | 5.96 |
| Anionic surfactant (active) | 1.64 | 1.6 | 1.88 | 1.6 | 0.77 |
| Cation | 5.67 | 5.67 | 5.67 | 5.67 | 5.67 |
| Anion | 1.54 | 1.45 | 1.75 | 1.45 | 0.72 |
| Total cation and anion | 6.21 | 7.12 | 7.42 | 7.12 | 6.39 |
| Normality ratio, cation/anion | 2.9 | 2.8 | 2.2 | 2.8 | 3.1 |
| Mp of particles | <95° | <95° | 60° | 50° | <95° |

All the compositions of Examples 1 to 27 were of uniform turbidity with a clear point of above 95° and were dispersions in an isotropic aqueous medium of positively charged particles of softening agent.

EXAMPLES 28 TO 31

A fabric-softening process was carried out using the compositions of Examples 24,25,26 and 27, and a similar composition containing no added anion-providing compound as control. Each composition was dispersed in demineralised water to give a dilute aqueous dispersion containing 0.084% by weight of the composition: 3 pieces of cotton towelling (40 g) were washed in a Tergotometer pot with 800 ml of dilute aqueous dispersion at 20° for 10 min., followed by spin-drying and drying in a hot air cabinet.

The process using the compositions was carried out in a series of Tergotometer pots, with each of the compositions used 5 times in different pots. The resulting cloth pieces were then assessed for relative softness in ranking order by a panel of 5 persons, according to a statistical design enabling all the compositions to be compared and giving total scores, in which the lower the score the more effective is the composition as a softener. The total scores were as follows.

| Examples | 28 | 29 | 30 | 31 | Control |
|---|---|---|---|---|---|
| Composition of Example | 24 | 25 | 26 | 27 | |
| Softening score | 166 | 166 | 154 | 256 | 233 |

These results indicate that the compositions of the Examples gave a fabric-softening effect that was always at least as good as that obtained with the control composition, a difference in score of less than 60 being insignificant.

We claim:

1. A pourable liquid fabric-softening composition of uniform turbidity comprising a dispersion in an isotropic aqueous medium of positively charged particles of softening agent with a melting point of below 95° C., which particles comprise a quaternary ammonium salt fabric softener having one straight-chain aliphatic hydrocarbon radical with from 12 to 24 carbon atoms, the chloride salt of whose cation A has a Krafft point in water of less than 95° C., complexed with the anion B of an anionic surfactant salt having one straight-chain aliphatic hydrocarbon radical with from 12 to 24 carbon atoms, the normality ratio of A to B being in the range from 1.1:1 to 5:1, the total weight of A and B present being from 2 to 15% by weight of the composition, and the composition having a clear point of above 95° C.

2. A composition according to claim 1, in which the quaternary ammonium salt has the structure $R'—AR_3N^+X^-$, where R' is a straight-chain aliphatic hydrocarbon radical having from 12 to 24 carbon atoms, A represents a single bond or a group —COOR"—, —OOCR"—, —CONHR"—, —NHCOR"—, $—SO_2NHR"—$, or $2Y_m(OCH_2CH_2)_n—$, where R" is an alkylene or hydroxyalkylene group having from 1 to 3 carbon atoms, and Y is a phenylene group, m is 0 or 1 and n is 1 to 3, and (a) each group R is an alkyl or hydroxyalkyl group having from 1 to 6 carbon atoms or a benzyl group, or (b) 2 or 3 of the groups R taken together with the nitrogen atom, represent a heterocyclic radical and any remaining group R is an alkyl or hydroxyalkyl group having from 1 to 6 carbon atoms or a benzyl group, and $X^-$ is an anion.

3. A composition according to claim 2, in which the quaternary ammonium salt has the structure $R^1R_3N^+X^-$, where $R^1$ is a straight-chain aliphatic hydrocarbon group having from 12 to 24 carbon atoms and each group R is an alkyl group having from 1 to 6 carbon atoms.

4. A composition according to claim 2, in which the quaternary ammonium salt has the structure $R^1COOCH_2CH_2R_3N_3^+X^-$, where $R^1$ and R are as defined in claim 3.

5. A composition according to claim 2, in which the quaternary ammonium salt has the structure $R^1COOCH_2CHOHCH_2R_3N^+X^-$, where $R^1$ and R are as defined in claim 3.

6. A composition according to claim 1, in which the anion B is provided by an alkali metal salt of an organic acid.

7. A composition according to claim 1, in which the anion B is provided by a free organic acid.

8. A composition according to claim 6, in which the acid is an aliphatic carboxylic acid having from 12 to 24 carbon atoms.

9. A composition according to claim 6 in which the acid is an alkylsulphuric acid having from 12 to 24 carbon atoms.

10. A composition according to claim 6 in which the acid is an alkane or olefin sulphonic acid having from 12 to 24 carbon atoms.

11. A composition according to claim 6, in which the acid is an alkylbenzene sulphonic acid where the alkyl group has from 12 to 24 carbon atoms.

12. A process for preparing a composition according to claim 1, in which a homogeneous liquid mixture of the quaternary ammonium salt and anion-providing compound is mixed with water and subjected to shear at an elevated temperature until a dispersion is formed.

* * * * *